United States Patent [19]

Hirota

[11] 4,304,334

[45] Dec. 8, 1981

[54] NESTABLE AND STACKABLE BOTTLE CASE

[75] Inventor: Kashichi Hirota, Hachioji, Japan

[73] Assignee: North American Beverage Cases, Inc., Atlanta, Ga.

[21] Appl. No.: 93,694

[22] Filed: Nov. 13, 1979

[51] Int. Cl.[3] ..... B65D 21/04

[52] U.S. Cl. ..... 206/507

[58] Field of Search ..... 206/507, 505, 506

[56] References Cited

U.S. PATENT DOCUMENTS

| | | | |
|---|---|---|---|
| 3,393,827 | 7/1968 | Asenbauer | 206/507 |
| 3,547,309 | 12/1970 | Pusey | 206/507 |
| 3,773,213 | 11/1973 | Frederick | 206/507 |
| 4,011,948 | 3/1977 | Rehrig | 206/507 |

FOREIGN PATENT DOCUMENTS

| | | | |
|---|---|---|---|
| 1186190 | 4/1970 | United Kingdom | 206/507 |

*Primary Examiner*—George E. Lowrance

*Attorney, Agent, or Firm*—Newton, Hopkins & Ormsby

[57] ABSTRACT

An eight bottle carrying case constructed from durable high density polyethylene is lightweight and easy to clean. The case can be nested when empty with similar cases to conserve space and, when full, can be stacked with like cases in an aligned array of cases or cross-stacked on two underlying like cases which are side-by-side and across the long axis of the above cross-stacked case or cases. To convert from aligned stacking of the cases to nesting thereof, alternate cases are turned 180 degrees relative to each other to alter the supportive and interfitting relationship of integral struts on the opposite long side walls of each case. The struts of each case also form bottle positioning means in the case.

5 Claims, 13 Drawing Figures

FIG 9
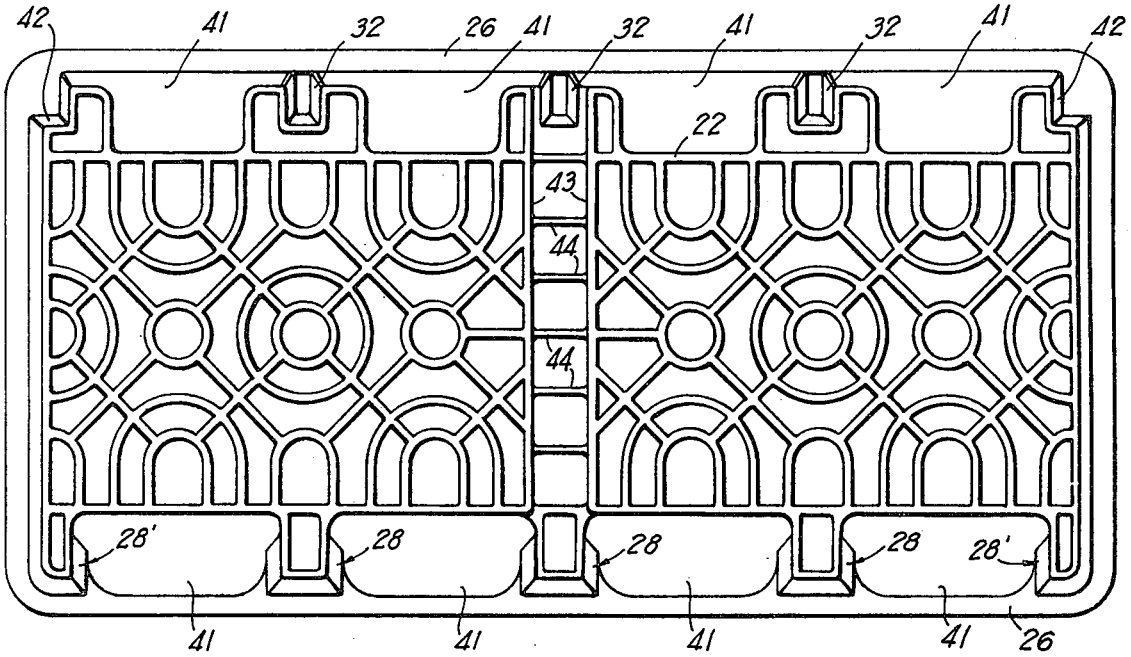
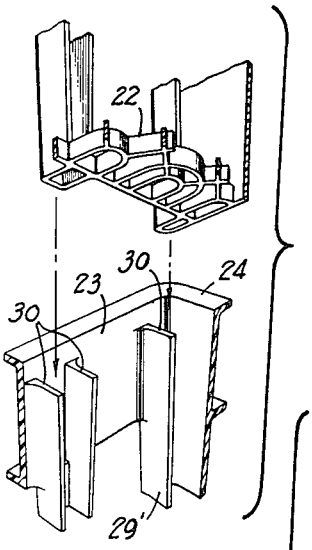
FIG 10
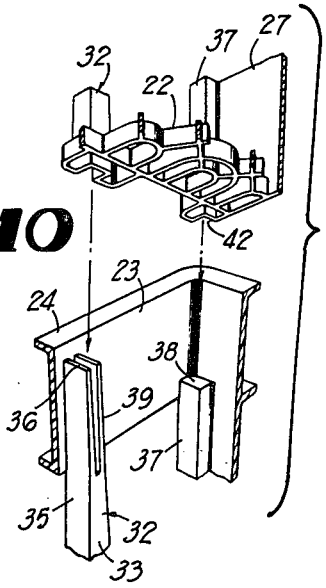
FIG 11
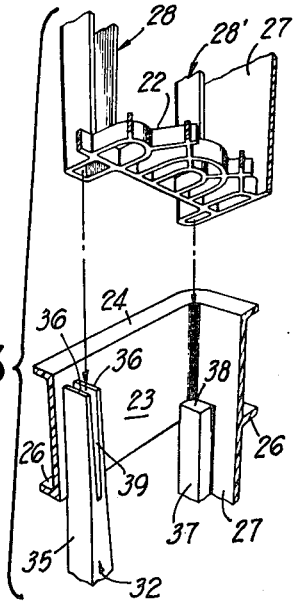
FIG 12
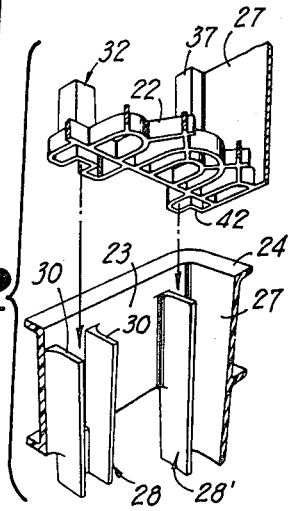
FIG 13

NESTABLE AND STACKABLE BOTTLE CASE

BACKGROUND OF THE INVENTION

The advantages of nestable and stackable carriers for bottles and other containers are recognized in the prior art over other carrier types including collapsible or foldable bottle carriers which lack durability and are difficult to clean.

The objective of this invention is to improve on the construction of high density plastic bottle carriers or cases of the non-collapsible type. More particularly, the invention seeks to provide a case of increased strength and durability for the popular two liter drink bottle, preferably in the form of an eight bottle case but not limited to this capacity.

A further objective of the invention is to reduce the amount of material in the case without structurally weakening it and in so doing to improve the cleanability of the case.

Another objective is to provide a bottle case of the class mentioned which can be stacked while filled with bottles stably in two modes, namely, aligned stacking and cross-stacking, and when empty can be nested with other empty cases to conserve space and without the difficulty of the nested cases becoming wedged together so that they are difficult to separate. In the above manner, the utility and the versatility of the bottle case is enhanced over the known prior art.

Another and more specific object of the invention is to provide in a bottle case of the type mentioned coacting guide struts for nesting the cases which also form rigidly engaged support columns for stacked cases when alternate cases to be stacked are rotated 180 degrees from their respective nesting positions. A further feature of the invention resides in the use of integral struts on the long side walls of each case as structural stiffening means for the case and also as internal locator or positioning means for bottles within the case, without the necessity for the case to include traditional right angular crossing bottle cell walls or partitions.

These and other advantages of the invention will readily appear to those skilled in the art during the course of the following description.

BRIEF DESCRIPTION OF THE DRAWINGS

FIG. 9 is a bottom plan view of the case as depicted in FIGS. 1 and 2.

FIG. 10 is a fragmentary exploded perspective view of two cases arranged for nesting.

FIG. 11 is a similar view showing different portions of the two cases arranged for nesting.

FIG. 12 is a similar view of two cases arranged for stacking.

FIG. 13 is a similar view of different portions of the two cases arranged for stacking.

DETAILED DESCRIPTION

Figure 1:
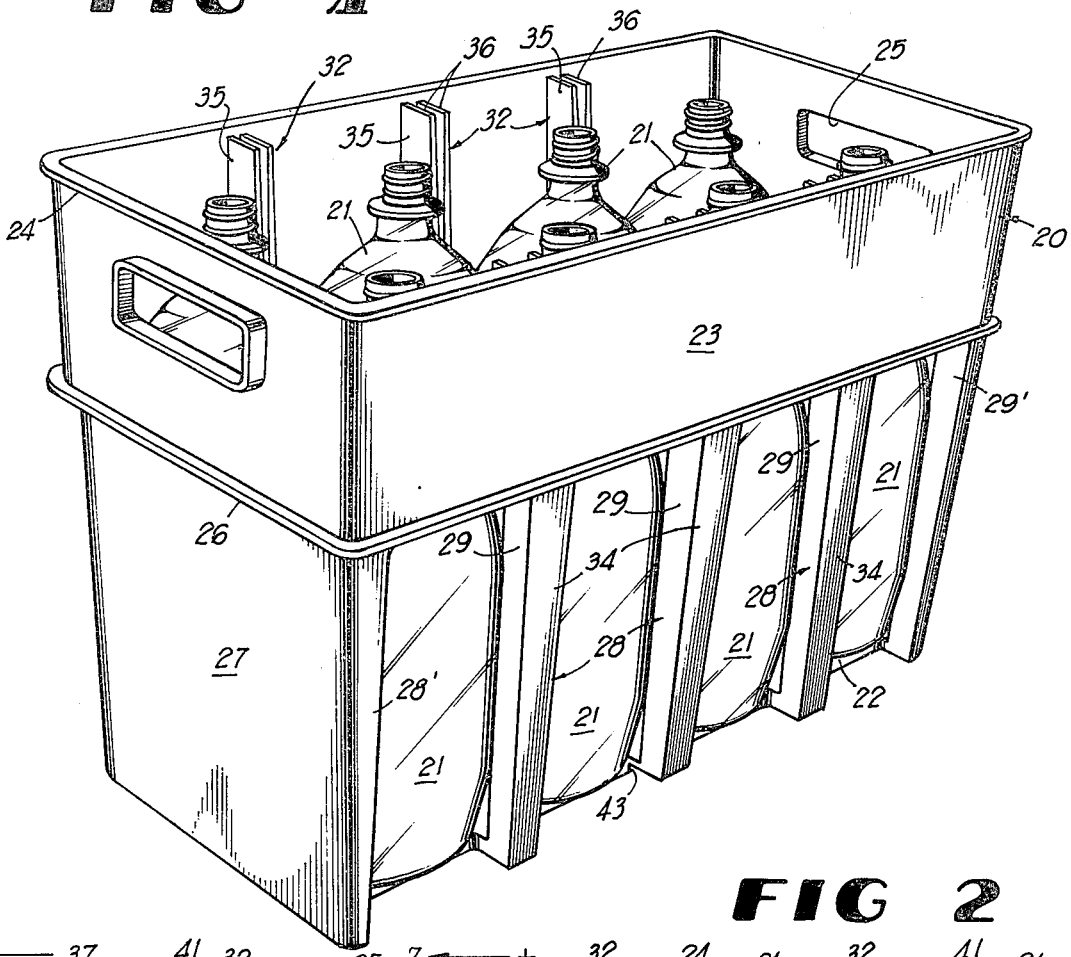
FIG. 1 is a perspective view of a full eight bottle case or carrier in accordance with the invention.

Referring to the drawings in detail wherein like numerals designate like parts throughout, a unitary molded high density polyethylene eight bottle case 20 is provided in accordance with the invention for transporting the popular one liter drink bottles 21 shown in FIG. 1. It should be recognized that in terms of size the invention is not limited in its use to this particular type of bottle and can be constructed to accept other types and sizes of containers within the inventive concept.

The bottle case 20 is substantially rectangular and elongated and has a constant height above its bottom wall 22, the case being open at its top for the easy deposit and removal of the bottles 21.

The upper portion of the case 20 comprises a solid wall 23 which extends continuously around the margin of the rectangular case and is topped by a continuous level outwardly projecting flange or lip 24. A pair of lift openings 25 are formed in the opposite end portions of the solid wall 23, as shown.

At the bottom of the solid wall 23, a marginal continuous level outwardly projecting flange 26 parallel to the flange 24 is formed on the case for an important purpose to be described. Below the marginal flange 26, the two end walls 27 of the bottle case are solidly formed, whereas the long side walls of the case below the upper solid wall 23 are of framed construction in a manner now to be described.

Along one longitudinal side of the case 20, three equidistantly spaced vertical struts 28 and one pair of end half-struts 28′ rise from the bottom wall 22 and are integrally attached thereto. The struts 28 are of channel cross section with their interior sides open. The half-struts 28′ are similarly closed at their outer sides and open inwardly, as clearly shown in FIGS. 2 and 3. The opposite side webs 29 of struts 28 and the single side webs 29′ of half-struts 28′ are inclined to the vertical and diverge upwardly to points of termination 30, FIG. 3, slightly below the top flange 24. The side webs of struts 28 above the flange 26 are parallel as at 31 whereas the side webs 29′ continue to be inclined up to their terminals 30. The respective webs 29′ and 31 are joined integrally with the upper solid wall 23 of the case.

On the opposite long side of the case 20, three spaced struts 32 rise from the case bottom wall 22 is opposed relationship to the three struts 28. At their lower ends, the struts 32 are integrally joined to the structure of the bottom wall 22. The struts 32 are hollow and have their outer sides open below the solid wall 23 and their closed webs 33 innermost, FIG. 7. The closed webs 34 of struts 28 are arranged outermost on the case 20. Unlike the struts 28, the side walls of the struts 32 converge upwardly as indicated at 35 throughout the full heights of the struts 32. Th top ends 36 of struts 32 terminate at the same heights as the terminals 30 of struts 28. At the two corners of the case opposite the half-struts 28′, rectangular cross section bar-like elements 37 are provided in the case for a purpose to be described. The top faces 38 of the bar-like elements 37 terminate at levels well below the top terminals 36 of struts 32 and near and above the lower boundary solid wall 23, FIG. 4. The upper end portions of the upwardly tapering struts 32 are bifurcated in the region of the wall 23 as at 39. Except for the several struts 28 and 32, the two long sides of the case 20 above the bottom wall 22 and below solid marginal wall 23 are open.

Figure 2:
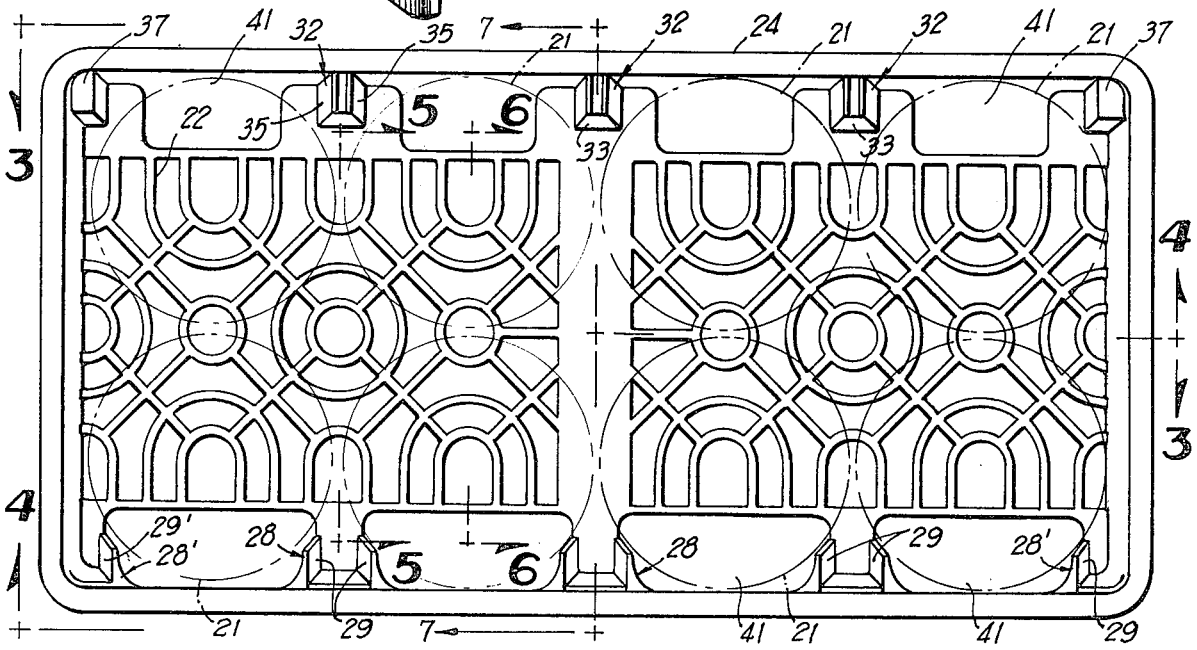
FIG. 2 is a plan view of the case.
Figure 5:
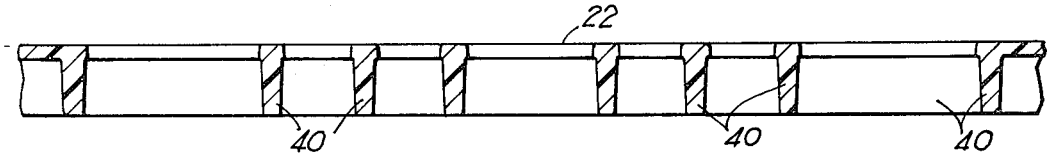
FIG. 5 is a fragmentary vertical cross section through the bottom wall of the case taken on line 5—5 of FIG. 2.
Figure 6:
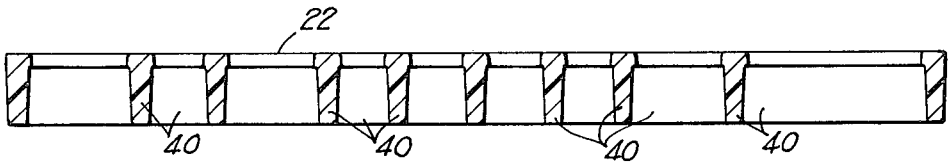
FIG. 6 is a similar view taken on line 6—6 of FIG. 2.

For the sake of lightness without sacrifice of strength and rigidity, the bottom wall 22 of the case is in the form of a geometric gridwork whose configuration can vary, one gridwork form being illustrated in FIGS. 2 and 9. The vertically elongated stiffening ribs 40 afforded by the bottom wall gridwork are shown clearly in FIGS. 5 and 6. These ribs render the bottom wall 22 quite rigid. Between the several struts 28, 28' and 32, the bottom wall has rather large cut-outs 41 to reduce weight, these cut-outs being clearly shown in FIGS. 2 and 9. The top face of gridwork bottom wall 22 is flat and level over it entire area. For a purpose to be described, bottom corner right angular recesses 42 are formed in the case 20 at the side thereof having the struts 32, FIG. 9. The end walls 27 of the case have no struts or other projections thereon.

The above-described integral construction of the case 20 promotes a unique and diversified mode of use, now to be described.

In addition to rendering the case side walls quite rigid, the struts 28 and 32 form locators for the bottles 21 whose outlines are shown in FIG. 2. When properly placed in the case, the bottles are substantially tangent to one another and tangent to the side and end walls of the rectangular case as well as to the corners of the several struts. The use of a single case 20 for transporting eight of the bottles 21 and holding them against displacement in the case is adequately illustrated in FIG. 1.

Figure 3:
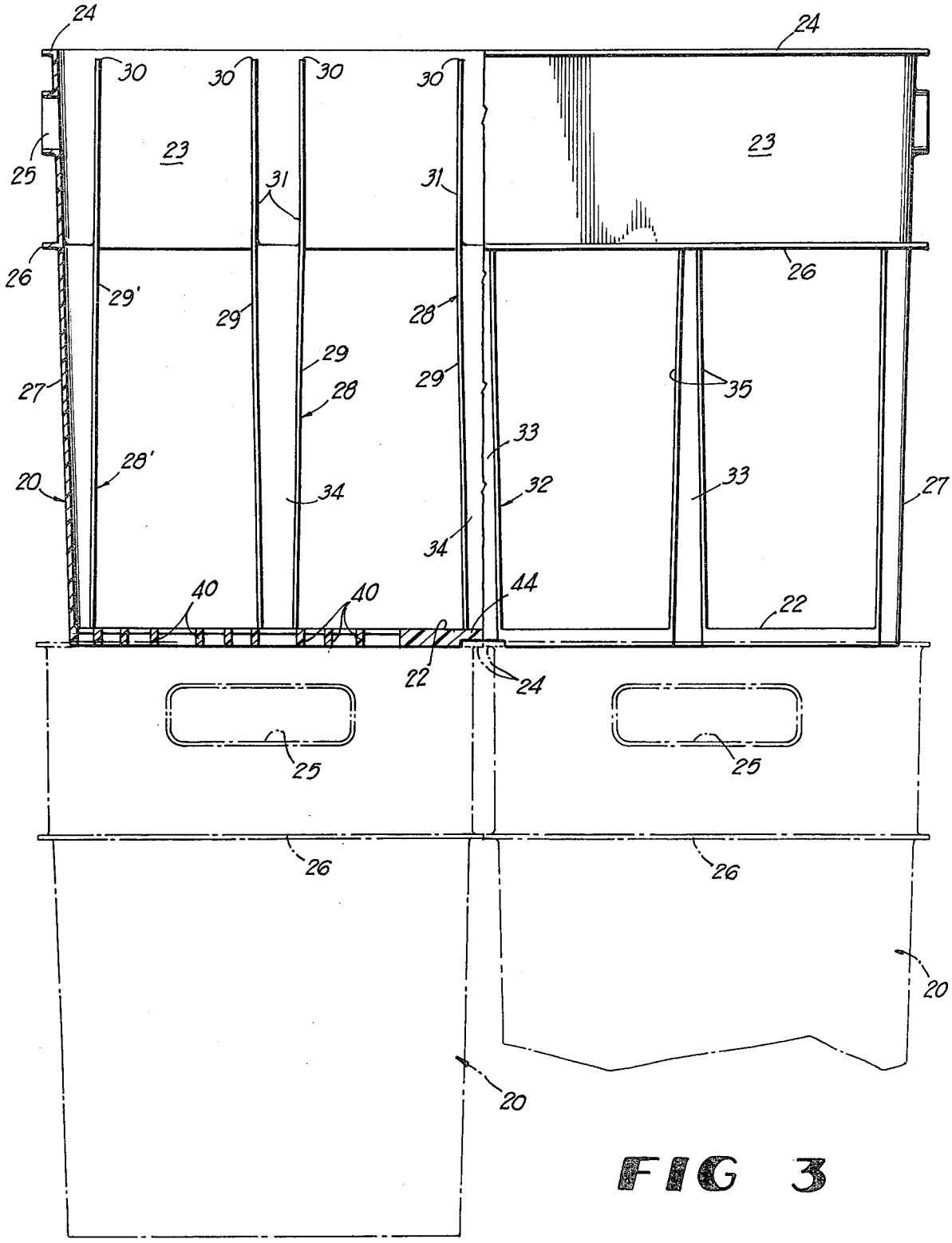
FIG. 3 is a vertical cross section, partly in elevation, taken on line 3—3 of FIG. 2 and showing a cross-stacked relationship of a case with two underlying side-by-side like cases.

FIG. 3 shows that one or two bottle cases 20 filled with bottles can be cross-stacked with two underlying side-by-side cases 20 with the long axes of the two tiers of stacked cases extending at right angles. Referring to FIG. 9, in order to promote the cross-stacking as shown in FIG. 3, the bottom wall 22 includes at the longitudinal center of the case a pair of spaced parallel ribs 43 interconnected by short cross ribs or ladder ribs 44 which are recessed upwardly above the bottom face plane of the ribs 43. As best shown in FIG. 3, this recessed arrangement in the ribbed bottom wall 22 allows the bottom of each cross-stacked case 20 to become interlocked with the top side-by-side flanges 24 of the two underlying cases 20. The interlocking recess in the bottom wall 22 for cross-stacking also appears in FIG. 4.

When plural cases are cross-stacked in the described manner, the bottoms of the cases in each tier rest solidly on the two underlying side-by-side cases 20, as depicted in FIG. 3.

Figure 7:
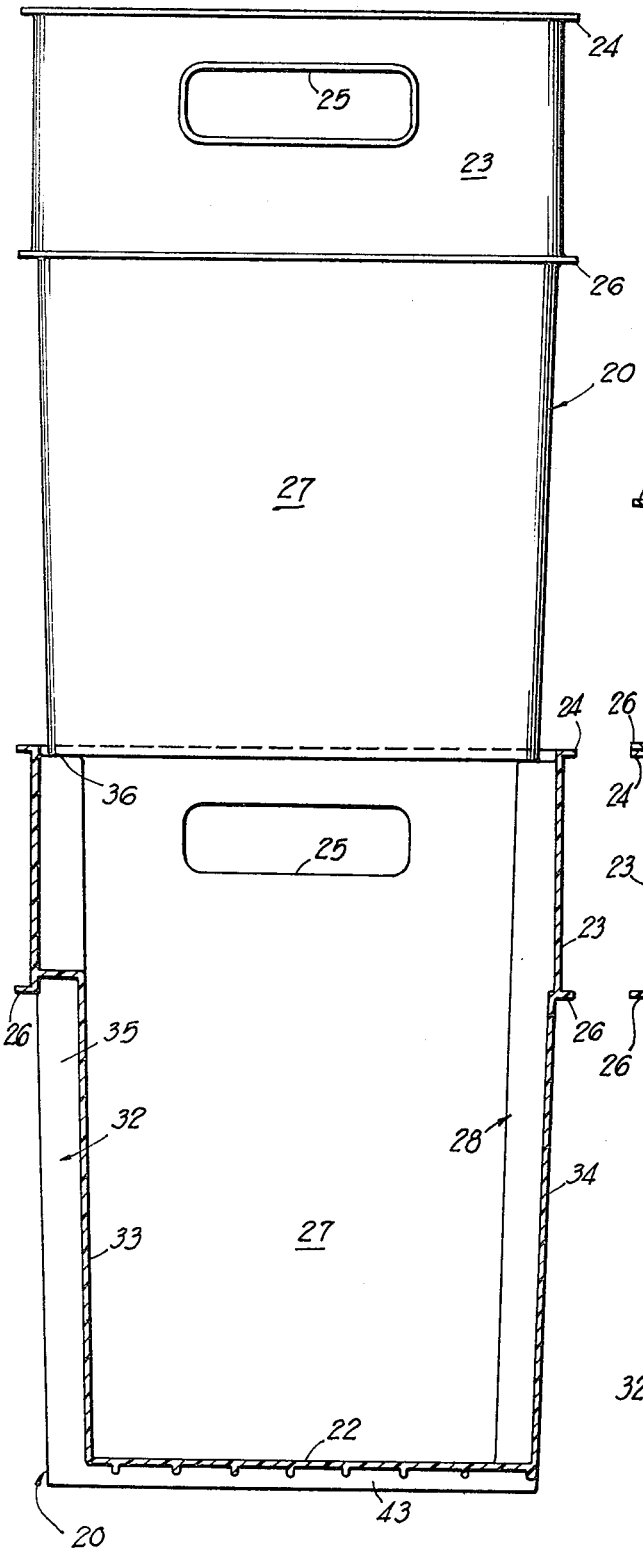
FIG. 7 is a transverse vertical section through the case taken on line 7—7 of FIG. 2 and showing the case stacked in alignment with an overhead like case.

The construction of the case 20 also facilitates aligned stacking thereof with other like cases as shown in FIG. 7 and also in FIGS. 12 and 13 of the drawings. In these particular figures, the lower ends of the upwardly tapering or convergent struts 32, namely their wider ends, are in end-to-end opposing and abutting relationship with the top ends 30 of the downwardly tapering or convergent struts 28 and 28' of the underlying case 20. In this situation, the engaging struts 28 and 32 cannot telescope one into the other, but instead form supportive columns for the aligned stacked bottle cases 20. FIG. 7, as well as FIGS. 12 and 13, show the normal aligned stacking relationship of two cases 20. The oppositely tapering struts 28 and 32 for both of the stacked cases 20 are on the opposite long sides of the two cases. Thus, in FIGS. 12 and 13 as shown by the projection lines, when the two cases are brought into stacking engagement, the upper larger ends of the struts 28 of the lower case 20 become engaged supportively with the larger lower ends of the struts 32 along the same sides of the two cases. Along the opposite long side, the smaller top ends of the struts 32 of the lower case 20 are engaged supportively with the smaller ends of the struts 28 along that same side. This means that the two cases cannot nest as in FIGS. 4 and 8 and are solidly supported in their normally aligned stacking relationship by end-to-end engagement of the tapering struts, as described.

Figure 4:
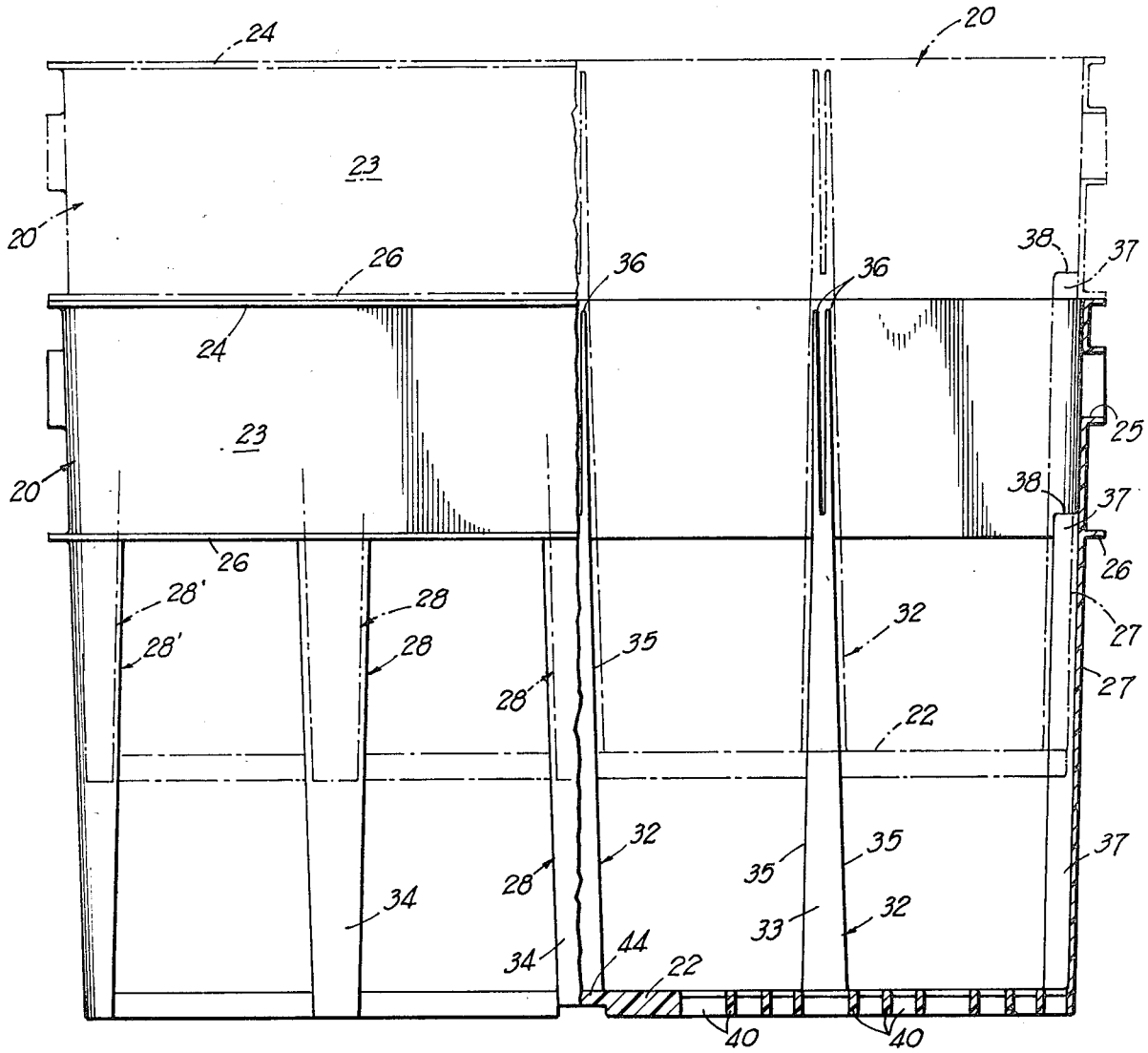
FIG. 4 is a similar view taken on line 4—4 of FIG. 2.
Figure 8:
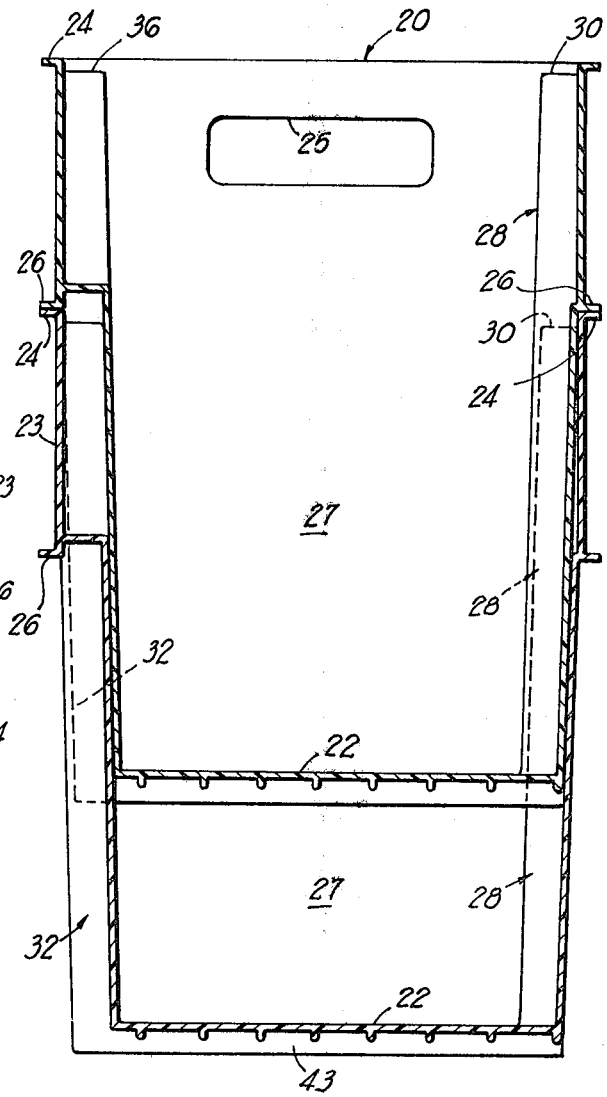
FIG. 8 is a view similar to FIG. 7 with the uppermost case in FIG. 7 also in transverse cross section and turned 180 degrees relative to the lower case and nested therewith.

In order to nest the cases 20, as shown in FIGS. 4 and 8, alternate cases 20 are rotated 180 degrees or end-to-end. This rotation places the upwardly tapering struts 32 of two adjacent cases at the same long side of the cases and the downwardly tapering struts 28 of the two cases at the other corresponding side in registry. This condition is depicted in FIGS. 10 and 11 as well as in FIGS. 4 and 8. Therefore, when two or more cases 20 are nested, as best shown in FIG. 4, the downwardly tapering struts 28 and 28' can interfit nestingly and the upwardly tapering struts 32 can likewise nest or interfit. This situation is also shown in FIG. 8. The two or more cases 20 so nested will telescope until the flange 26 of the uppermost case 20 abuts and rests upon the flange 24 of the lower case to positively limit nesting and avoid overnesting, whereby the cases could become tightly wedged making it difficult to separate them. Additionally, in the nesting operation, the corner elements 37 are keyed into the corner recesses 42, as indicated in FIGS. 4 and 11. The essence of the matter, therefore, is the simple turning of alternate bottle cases 180 degrees relatively to position their opposite side and oppositely tapering struts 28 and 32 for end-to-end supportive engagement or for telescopic engagement.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A case for bottles comprising a generally rectangular body portion having an open top, a bottom wall, end walls and a pair of opposing side walls, plural spaced laterally aligned pairs of struts on the interiors of said side walls extending substantially from the bottom wall to the top of said case, the struts on one side wall tapering longitudinally from bottom-to-top and the struts on the other side wall tapering longitudinally from top-to-bottom and opppositely to the direction of taper of said one side wall, whereby two bottle cases are stackable one upon the other with the struts of opposite taper of both cases arranged at opposite sides of both cases and having registering ends in supportive abutment, the two cases being nestable one within the other by rotating one case 180 degrees relative to the other case to thereby locate struts of like taper of both cases at the same sides of both cases in telescoping engagement.

2. A bottle case as defined in claim 1, and said case having a first marginal flange substantially at its top and a second parallel marginal flange at an elevation below the first flange, whereby when two cases are nested the second marginal flange of the topmost case will rest on the first marginal flange of the bottom-most case to limit the extent of nesting and prevent tight wedging of the two cases.

3. A bottle case as defined in claim 1, and said case being formed as a unit from plastics material.

4. A bottle case as defined in claim 1, and the bottom wall of the case having a transverse recess extending thereacross in its lower surface substantially at the longitudinal center of the case, said recess being adapted to interlock with top longitudinal edges of two underlying side-by-side like cases when said case is cross-stacked therewith.

5. A bottle case as defined in claim 1, and said struts on said opposing side walls being of channel cross section with the side webs of the struts on one side wall converging downwardly and the side webs of the struts on the other side wall converging upwardly, all of the struts having their open sides facing inwardly at least on one side wall of said case.

* * * * *